US008844506B2

(12) United States Patent
Spix et al.

(10) Patent No.: US 8,844,506 B2
(45) Date of Patent: Sep. 30, 2014

(54) POSITIVE CRANKCASE VENTILATION SYSTEM

(75) Inventors: Thomas A. Spix, Rochester Hills, MI (US); Alan E. Rice, New Baltimore, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 281 days.

(21) Appl. No.: 13/473,890

(22) Filed: May 17, 2012

(65) Prior Publication Data

US 2013/0306043 A1 Nov. 21, 2013

(51) Int. Cl.
*F01M 13/00* (2006.01)

(52) U.S. Cl.
USPC ..... 123/572

(58) Field of Classification Search
USPC ..... 123/572–574, 41.86
IPC ..... F01M 13/00,13/033, 13/021, 13/022, F01M 13/0405, 13/0416
See application file for complete search history.

(56) References Cited

U.S. PATENT DOCUMENTS

| | | | | | |
|---|---|---|---|---|---|
| 4,175,937 | A * | 11/1979 | Brandau et al. | 55/419 |
| 4,528,969 | A * | 7/1985 | Senga | 123/572 |
| 5,954,035 | A * | 9/1999 | Hofer et al. | 123/573 |
| 7,842,115 | B2 * | 11/2010 | Brand et al. | 55/459.1 |
| 8,181,634 | B2 * | 5/2012 | Spix et al. | 123/572 |
| 8,408,190 | B2 * | 4/2013 | Spix et al. | 123/572 |
| 8,602,008 | B2 * | 12/2013 | Spix et al. | 123/572 |
| 2010/0101514 | A1 * | 4/2010 | Hirano et al. | 123/41.86 |

* cited by examiner

*Primary Examiner* — M. McMahon
(74) *Attorney, Agent, or Firm* — Quinn Law Group, PLLC

(57) ABSTRACT

An engine assembly includes an engine defining a combustion chamber and a crankcase volume, together with an intake assembly. The intake assembly includes an air cleaner assembly, a throttle, and an intake manifold in a series arrangement and fluidly coupled with the combustion chamber. An air-oil separator is fluidly coupled between the crankcase volume and the intake manifold and defines a separator volume configured to extract oil from air flowing through the volume. The air-oil separator includes a first inlet port configured to direct a first air flow into the separator volume substantially along a first direction, and a second inlet port configured to direct a second air flow into the volume substantially along a second direction that generally opposes the first direction.

17 Claims, 2 Drawing Sheets

POSITIVE CRANKCASE VENTILATION SYSTEM

TECHNICAL FIELD

The present invention relates generally to a positive crankcase ventilation system with an air-oil separator configured to extract oil from engine blowby gasses.

BACKGROUND

During engine operation, combustion gas may leak between the cylinder and the corresponding piston rings, and into the engine crankcase. The leaked combustion gas is referred to as blowby gas, and typically includes intake air, unburned fuel, exhaust gas, oil mist, and water vapor. In an effort to ventilate the crankcase and re-circulate the blowby gas to the intake side of the engine, a positive crankcase ventilation (PCV) system may be used.

SUMMARY

An engine assembly includes an engine defining a combustion chamber and a crankcase volume, together with an intake assembly. The intake assembly includes an air cleaner assembly, a throttle, and an intake manifold in a series arrangement and fluidly coupled with the combustion chamber. An air-oil separator is fluidly coupled between the crankcase volume and the intake manifold and defines a separator volume configured to extract oil from air flowing through the volume. The air-oil separator includes a first inlet port configured to direct a first air flow into the separator volume substantially along a first direction, and a second inlet port configured to direct a second air flow into the volume substantially along a second direction that generally opposes the first direction.

The first inlet port and second inlet port may be spaced apart to define a turbulent zone, with the first inlet port and second inlet port being disposed on opposing sides of the turbulent zone. During operation, the first air flow and the second air flow may be configured to pass through the respective inlet ports and collide within the turbulent zone.

In one configuration, the separator volume may be adjacent to the camshaft volume, though may be separated from the camshaft volume by a partition. As such, each of the first inlet port and second inlet port may be respectively defined by the partition to allow air flow to pass from the camshaft volume into the air-oil separator volume.

The first inlet port may include a first baffle disposed at an angle relative to the partition, and the second inlet port may include a similarly configured second baffle disposed at an angle to the partition. In one configuration, each of the first baffle and second baffle respectively protrudes into the separator volume. Additionally, the first inlet port may define a first orifice, and the second inlet port may similarly define a second orifice. The first orifice and the second orifice may be separated by a distance, and the first baffle and second baffle may be outwardly disposed from the first orifice and the second orifice. The first baffle may be configured to direct the first air flow through the first orifice and into the turbulent zone between the first orifice and the second orifice, and similarly, the second baffle may direct the second air flow through the second orifice and into the same turbulent zone, where the air flows may collide.

In one configuration, the air-oil separator may be fluidly coupled with the camshaft volume through each of the first and second inlet ports. Additionally, the camshaft volume may be fluidly coupled with the crankcase volume through a first fluid conduit. The air-oil separator may further be fluidly coupled with the intake manifold through a second fluid conduit, and the crankcase volume may be fluidly coupled with the air cleaner assembly through a third fluid conduit.

The above features and advantages and other features and advantages of the present invention are readily apparent from the following detailed description of the best modes for carrying out the invention when taken in connection with the accompanying drawings.

DETAILED DESCRIPTION

Figure 1:
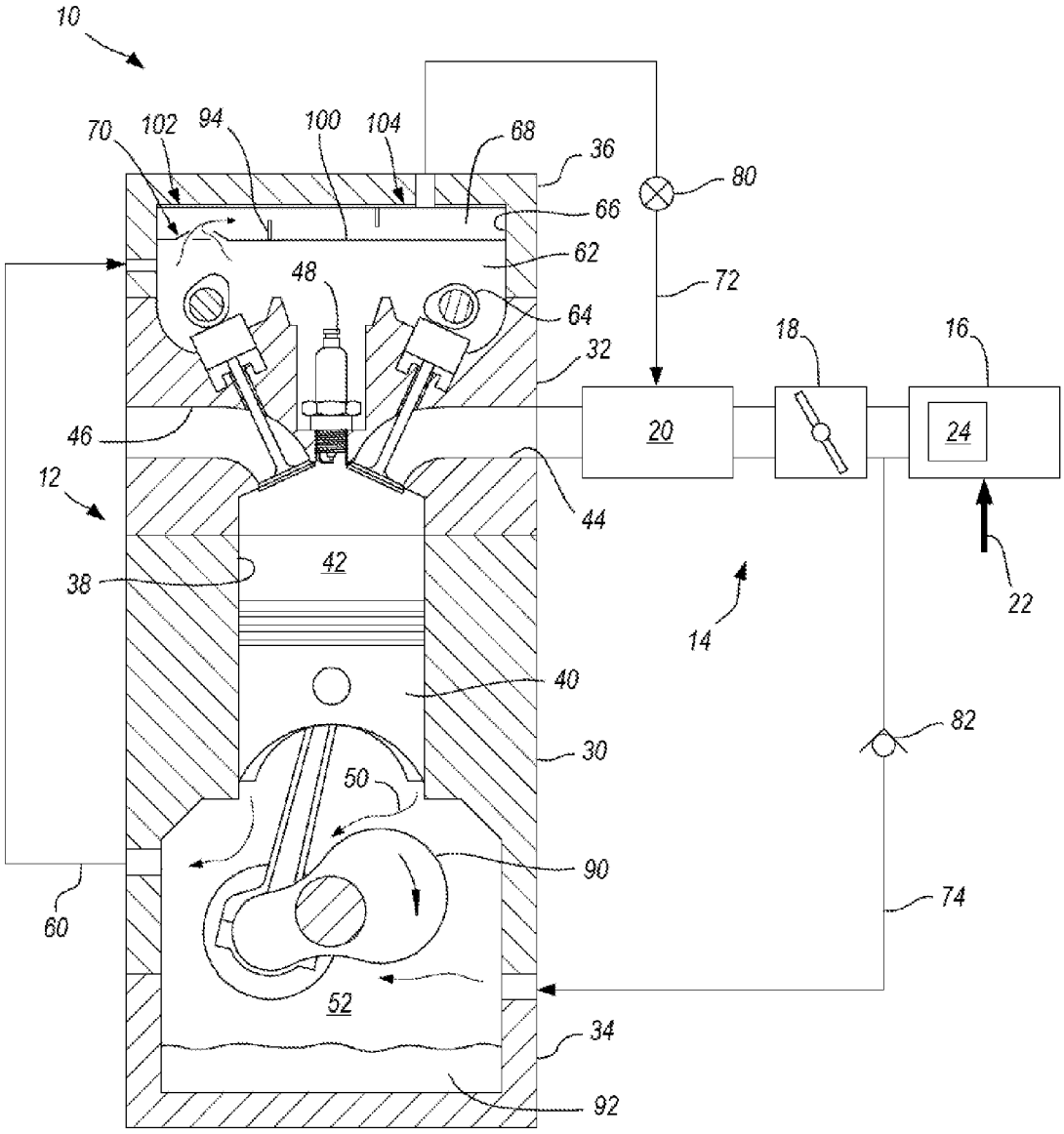
FIG. 1 is a schematic partial cross-sectional illustration of a positive crankcase ventilation system operating with an engine assembly.

Referring to the drawings, wherein like reference numerals are used to identify like or identical components in the various views, FIG. 1 schematically illustrates an engine assembly 10 including both an engine 12 and an intake assembly 14. The intake assembly 14 may include, for example, an air cleaner assembly 16, a throttle 18, and an intake manifold 20 disposed in a series arrangement. The throttle 18 may be disposed between the air cleaner assembly 16 and the intake manifold 20, and may be configured to selectively restrict the flow of air 22 into the intake manifold 20. The air cleaner assembly 16 may include housings, ports, and/or conduit that may be located upstream of the throttle 18. In one configuration, the air cleaner assembly 16 may include, for example, an air filter 24 with a sufficient porosity or other construction to filter airborne debris from the intake air 22 prior to its passage into the intake manifold 20.

The engine 12 may include an engine block 30, a cylinder head 32, an oil pan 34, and an engine cylinder head cover 36. The engine block 30 may define a plurality of cylinder bores 38 (one of which is shown), with each cylinder bore 38 having a reciprocating piston 40 disposed therein. The plurality of cylinder bores 38 may be arranged in any suitable manner, such as, without limitation, a V-engine arrangement, an inline engine arrangement, and a horizontally opposed engine arrangement, as well as using both overhead cam and cam-in-block configurations.

The cylinder head 32, engine block 30, and reciprocating piston 40 may cooperate to define a combustion chamber 42 for each respective cylinder bore 38. Additionally, the cylinder head 32 may provide one or more intake passages 44 and exhaust passages 46 in selective fluid communication with the combustion chamber 42. The intake passage 44 may be used to deliver an air/fuel mixture to the combustion chamber 42 from the intake manifold 20. Following combustion of the air/fuel mixture (such as when ignited by a spark from a spark plug 48), the exhaust passage 46 may carry exhaust gasses out of the combustion chamber 42.

During engine operation, an intake stroke of the piston 40 may draw intake air 22 through the air cleaner assembly 16, past the throttle 18, through the intake manifold 20 and intake passage 44, and into the combustion chamber 42, where fuel may be introduced via fuel injectors (not shown). During the power stroke of the piston 40, following the ignition of the air/fuel mixture in the combustion chamber 42, a portion of the combustion gas may pass between the piston 40 and the engine block 30 (i.e., blowby gas 50) and into the crankcase volume 52 (the crankcase volume 52 being generally defined by the engine 12 via the oil pan 34 and engine block 30). Because the blowby gas 50 includes an amount of un-burnt fuel and products of combustion (such as water vapor), it may be desirable to avoid having these gasses accumulate within the crankcase volume 52. Accordingly, a positive crankcase ventilation system (PCV system) may be used to purge the blowby gas 50 from the crankcase volume 52.

The PCV system may utilize ducting, passageways, and/or volumes that may actively vent the blowby gas 50 from the crankcase volume 52 into the intake system 14 where it may eventually be exhausted via the exhaust passage 46. More specifically, the PCV system may include a first fluid passageway 60 that may fluidly couple the crankcase volume 52 with a volume 62 defined by the cylinder head cover 36 (i.e., the "camshaft volume 62"). As may be appreciated, the camshaft volume 62 may contain one or more rotating camshafts 64 that are configured to translate one or more valves.

Adjacent to the camshaft volume 62, the PCV system may include an air-oil separator 66 that generally defines a separator volume 68. In one configuration, the separator volume 68 may be fluidly coupled with the camshaft volume 62 through a plurality of ports 70. The separator volume 68 may be fluidly coupled with the intake manifold 20 through a second fluid conduit 72. Additionally, the crankcase volume 52 may be coupled with the air cleaner assembly 16 through a third fluid conduit 74. Depending on the configuration of the engine 12, the first fluid conduit 60 may be, for example, a bore or channel within the engine 12, or may be, for example, a tube that extends between the crankcase volume 52 and the separator 66.

During normal operation (excluding wide-open throttle scenarios), the intake stroke of the engine 12 may generate a vacuum in the intake manifold 20 as a result of the throttle 18 partially blocking the intake air flow 22. This vacuum may draw the blowby gas 50 from the crankcase volume 52 through both the camshaft volume 62 and the separator volume 68 and into the intake manifold 20 via the first and second fluid conduits 60, 72. A portion of the air used to dilute the blowby gas 50 may be supplied via the third fluid conduit 74, which may be coupled to the air cleaner assembly 16 upstream of the throttle 18. As such, the pressure differential across the throttle 18 may generate a motive force that may actively vent the crankcase volume 52. One or more nozzles, restrictor orifices, or valves 80 may be positioned in line with the second fluid conduit 72 to provide generally constant flow under various engine operating conditions. Likewise, a check valve 82 may be positioned in line with the third fluid conduit 74 to prevent back flow from the crankcase volume 52 to the air cleaner assembly 16.

Due to engine vibrations, motion of the vehicle, the reciprocal motion of the piston 40, and/or the rotating motion of the crankshaft 90, oil 92 contained within the crankcase volume 52 may be splashed, foamed, atomized, misted and/or sprayed within the entire volume of the crankcase 52. The atomized/particulated oil, along with the intake air 22 and blowby gas 50, may then be drawn out of the crankcase volume 52, into the camshaft volume 62, via the first fluid conduit 60. While the atomized oil may be beneficial within the camshaft volume 62 to lubricate various moving parts (including the rotating camshafts 64), it is desirable to extract as much oil 92 from the blowby gas 50 before the gas 50 passes into the intake system 14 and combustion chamber 42. To accomplish the extraction, the separator volume 68 may be specially configured to separate and remove oil 92 from the flowing gas and allow the oil 92 to drain back into the crankcase volume 52. For example, the separator 66 may include one or more baffles (e.g., baffle 94), fins, or restrictions extending into the separator volume 68 that may aid in separating the oil from the air. These features may aid extraction by, for example, flow redirection or by creating a varying pressure along the flow path. For example, the inertia of the particulated oil 92 may cause the oil to collide with one of the baffles 94 or walls of the separator 60. Once in contact with the wall, the surface tension of the oil 92 may cause it to cling to the wall, where it may subsequently run off (via gravity) toward a drain.

In one configuration, as shown in FIG. 1, the separator volume 68 may be separated from the camshaft volume 62 by a thin walled partition 100 that may be constructed from, for example, stamped sheet metal or injection molded plastic. The plurality of ports 70 may be provided at an inlet portion 102 of the air-oil separator 66, while the second fluid conduit 72 may be coupled at an outlet portion 104. Due to the pressure drop across the throttle 18 the blowby gas 50 may be drawn through the separator volume 68 from the inlet portion 102 to the outlet portion 104.

Figure 2:
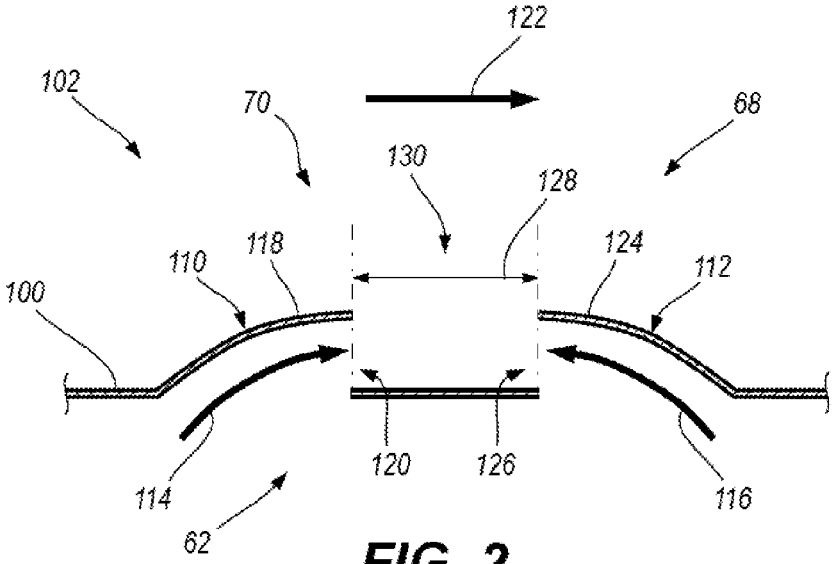
FIG. 2 is a partial schematic cross-sectional view of an inlet portion of an air-oil separator, including a first and second inlet port.

FIG. 2 provides an enlarged schematic cross-sectional view of the inlet portion 102 of the air-oil separator 66. As shown, the plurality of inlet ports 70 may be formed from an indented protrusion of the thin walled partition 100, and may extend into the separator volume 68. The plurality of inlet ports 70 may include at least a first inlet port 110 and a second inlet port 112 that are respectively configured to direct air flow 114, 116 from the camshaft volume 62 into the separator volume 68 in substantially opposing directions. More particularly, the first inlet port 110 may include an angular baffle 118 (i.e., angled relative to the partition 110) that is configured to direct air flow 114 through a port opening 120 in a direction that is substantially oriented towards the outlet portion 104 of the separator volume 68 (i.e., along direction arrow 122). Conversely, the second inlet port 112 may include an angular baffle 124 (i.e., angled relative to the partition 110) that is configured to direct air flow 116 through a port opening 126 in a direction that is substantially oriented away from the outlet portion 104 of the separator volume 68 (i.e., against direction arrow 122). The two respective port openings 120, 126 may be spaced apart by a distance 128 that generally defines a turbulent zone 130.

Within the turbulent zone 130, the air flow 114 through the first port opening 120 may collide with, intermingle with, and/or mix with the air flow 116 through the second port opening 126. This induced turbulence may promote smaller droplets of oil to consolidate with each other into larger droplets that may more readily precipitate out of the air flow 114, 116. Said another way, when the inlets 110, 112 are oriented such that the incoming gases collide with one another, the efficiency of the separator 66 may be increased. This increase in efficiency may correspondingly result in lower oil consumption, with more oil being recycled back to the crankcase volume 52 instead of being fed through the combustion chamber 42.

Figure 3:
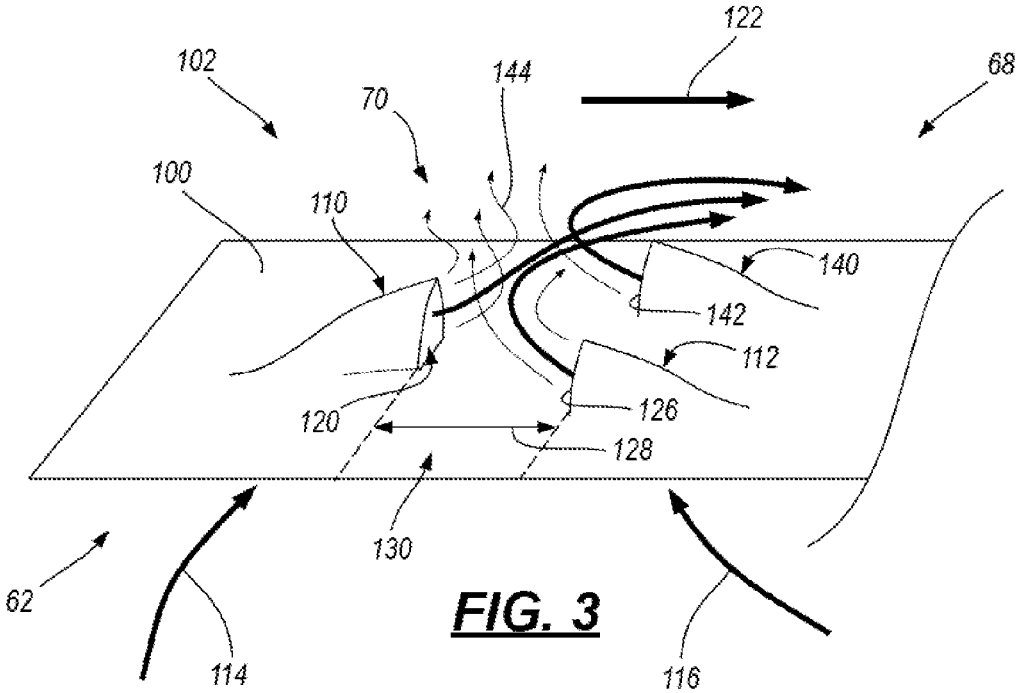
FIG. 3 is a schematic perspective view of an embodiment of an inlet portion of an air-oil separator.

FIG. 3 schematically illustrates a configuration of the inlet portion 102, which may be similar in operation to the configuration displayed in FIG. 2. As shown in FIG. 3, the inlet portion 102 includes a first inlet port 110 generally directing air flow 114 towards the outlet portion 104 of the separator volume 68 (i.e., along direction arrow 122). Additionally, FIG. 3 schematically illustrates a second and a third inlet port 112, 140 that each respectively direct air flow 116 away from the outlet portion 104 (i.e., against direction arrow 122). A turbulent zone 130 may be defined by the distance 128 between the first inlet port 110 and the respective second and third inlet ports 112, 140. Within the turbulent zone 130, air flow 114 through the first port opening 120 may collide with, intermingle with, and/or mix with the air flow 116 through the second port opening 126 and/or third port opening 142. While the substantial mass of the flow may be drawn toward the outlet portion of the separator volume 104, the intermingling of air flow from the various ports 110, 112, 140 may also result in non-laminar/turbulent air patterns 144, which are schematically illustrated as thinner weight air flow lines.

While the best modes for carrying out the invention have been described in detail, those familiar with the art to which this invention relates will recognize various alternative designs and embodiments for practicing the invention within the scope of the appended claims. All directional references (e.g., upper, lower, upward, downward, left, right, leftward, rightward, above, below, vertical, and horizontal) are only used for identification purposes to aid the reader's understanding of the present invention, and do not create limitations, particularly as to the position, orientation, or use of the invention. It is intended that all matter contained in the above description or shown in the accompanying drawings shall be interpreted as illustrative only and not as limiting.

The invention claimed is:

1. An engine assembly comprising:

an engine defining a combustion chamber, a camshaft volume, and a crankcase volume;

an intake assembly including an air cleaner assembly, a throttle, and an intake manifold disposed in a series arrangement, the intake manifold being fluidly coupled with the combustion chamber, and wherein the throttle is disposed between the air cleaner assembly and the intake manifold;

an air-oil separator fluidly coupled between the crankcase volume and the intake manifold, the air-oil separator defining a separator volume configured to extract oil from air flowing through the volume, and including:

a first inlet port configured to direct a first air flow into the separator volume substantially along a first direction;

a second inlet port configured to direct a second air flow into the separator volume substantially along a second direction that generally opposes the first direction; and wherein the separator volume is adjacent to the camshaft volume, and separated from the camshaft volume by a partition; and wherein each of the first inlet port and second inlet port are respectively defined by the partition.

2. The engine assembly of claim 1, wherein the first inlet port and second inlet port are spaced apart to define a turbulent zone, and wherein the first inlet port and second inlet port are on opposing sides of the turbulent zone.

3. The engine assembly of claim 2, wherein the first air flow and the second air flow are configured to collide within the turbulent zone.

4. The engine assembly of claim 1, wherein the first inlet port includes a first baffle disposed at an angle relative to the partition, the second inlet port includes a second baffle disposed at an angle to the partition; and wherein each of the first baffle and second baffle respectively protrudes into the separator volume.

5. The engine assembly of claim 4, wherein the first inlet port defines a first orifice, and the second inlet port defines a second orifice;

wherein the first orifice and the second orifice are separated by a distance; and wherein the first baffle and second baffle are outwardly disposed from the first orifice and the second orifice.

6. The engine assembly of claim 5, wherein the first baffle directs the first air flow through the first orifice and into a turbulent zone disposed between the first orifice and the second orifice; and wherein the second baffle directs the second air flow through the second orifice and into the turbulent zone.

7. The engine assembly of claim 1, wherein the air-oil separator is fluidly coupled with the camshaft volume through each of the first and second inlet ports; and wherein the camshaft volume is fluidly coupled with the crankcase volume through a first fluid conduit.

8. The engine assembly of claim 7, wherein the air-oil separator is fluidly coupled with the intake manifold through a second fluid conduit.

9. The engine assembly of claim 8, wherein the crankcase volume is fluidly coupled with the air cleaner assembly through a third fluid conduit.

10. The engine assembly of claim 1, wherein the engine includes an engine block, a cylinder head, an oil pan, and a cylinder head cover; and wherein the separator volume and camshaft volume are partially defined by the cylinder head and cylinder head cover.

11. An engine assembly comprising:

an engine defining a combustion chamber, a camshaft volume, and a crankcase volume;

an intake assembly including an air cleaner assembly, a throttle, and an intake manifold disposed in a series arrangement, the intake manifold being fluidly coupled with the combustion chamber, and wherein the throttle is disposed between the air cleaner assembly and the intake manifold and is configured to controllably restrict air flow into the intake manifold;

an air-oil separator fluidly coupled between the crankcase volume and the intake manifold, the air-oil separator defining a separator volume configured to extract oil from air flowing through the volume, and including:

a first inlet port configured to direct a first air flow into the separator volume substantially along a first direction; and a second inlet port configured to direct a second air flow into the separator volume substantially along a second direction that generally opposes the first direction; and wherein the separator volume is adjacent to the camshaft volume, and is separated from the camshaft volume by a partition; and wherein each of the first inlet port and second inlet port are respectively defined by the partition.

12. The engine assembly of claim 11, wherein the first inlet port and second inlet port are spaced apart to define a turbulent zone, and wherein the first inlet port and second inlet port are on opposing sides of the turbulent zone.

13. The engine assembly of claim 12, wherein the first air flow and the second air flow are configured to collide within the turbulent zone.

14. The engine assembly of claim 11, wherein the first inlet port includes a first baffle disposed at an angle relative to the partition, and wherein the second inlet port includes a and second baffle disposed at an angle to the partition; and wherein each of the first baffle and second baffle respectively protrudes into the separator volume.

15. The engine assembly of claim 14, wherein the first inlet port defines a first orifice, and the second inlet port defines a second orifice;

wherein the first orifice and the second orifice are separated by a distance; and wherein the first baffle and second baffle are outwardly disposed from the first orifice and the second orifice.

16. The engine assembly of claim 15, wherein the first baffle directs the first air flow through the first orifice and into a turbulent zone disposed between the first orifice and the second orifice; and wherein the second baffle directs the second air flow through the second orifice and into the turbulent zone.

17. The engine assembly of claim 11, wherein the air-oil separator is fluidly coupled with the camshaft volume through each of the first and second inlet ports; and wherein the camshaft volume is fluidly coupled with the crankcase volume through a first fluid conduit.

* * * * *